US011540609B2

(12) United States Patent
Oh et al.

(10) Patent No.: US 11,540,609 B2
(45) Date of Patent: Jan. 3, 2023

(54) CONCENTRATOR AND HAIR DRYER INCLUDING CONCENTRATOR

(71) Applicant: LG ELECTRONICS INC., Seoul (KR)

(72) Inventors: Hyunjoo Oh, Seoul (KR); Kwangwoon Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 115 days.

(21) Appl. No.: 17/098,864

(22) Filed: Nov. 16, 2020

(65) Prior Publication Data

US 2021/0353027 A1 Nov. 18, 2021

(30) Foreign Application Priority Data

May 18, 2020 (KR) ..... 10-2020-0058883

(51) Int. Cl.
*A45D 20/12* (2006.01)

(52) U.S. Cl.
CPC ..... *A45D 20/12* (2013.01)

(58) Field of Classification Search
CPC ..... A45D 20/12
USPC ..... 34/95–100; 392/380–384
See application file for complete search history.

(56) References Cited

U.S. PATENT DOCUMENTS

| | | | | |
|---|---|---|---|---|
| 3,374,789 | A * | 3/1968 | Maurer | A61C 17/0217 239/444 |
| 7,412,781 | B2 | 8/2008 | Mattinger et al. | |
| D638,579 | S * | 5/2011 | Alarcon | D21/616 |
| 9,282,799 | B2 * | 3/2016 | Courtney | A45D 20/124 |
| 9,675,158 | B2 * | 6/2017 | Soresina | A45D 20/12 |
| 9,808,066 | B2 * | 11/2017 | Moloney | A45D 20/48 |
| 10,010,150 | B2 * | 7/2018 | Courtney | A45D 20/00 |
| 10,849,400 | B2 * | 12/2020 | Weatherly | A45D 20/12 |
| 2021/0353027 | A1 * | 11/2021 | Oh | A45D 20/122 |
| 2021/0353031 | A1 * | 11/2021 | Oh | A45D 20/122 |

FOREIGN PATENT DOCUMENTS

| | | | |
|---|---|---|---|
| JP | 2531800 | 4/1997 | |
| JP | 2012-019865 | 2/2012 | |
| KR | 10-2016-0021862 | 2/2016 | |
| KR | 10-1934536 | 12/2018 | |
| KR | 10-2019-0004889 | 1/2019 | |
| KR | 10-2019-0017075 | 2/2019 | |
| KR | 10-2019-0040108 | 4/2019 | |
| WO | WO-2021235645 A1 * | 11/2021 | A45D 20/12 |

OTHER PUBLICATIONS

U.S. Appl. No. 17/098,607, filed Nov. 16, 2020.
U.S. Appl. No. 17/098,864, filed Nov. 16, 2020.
International Search Report issued in Application No. PCT/KR2021/000373 dated Aug. 23, 2021.
International Search Report issued in Application No. PCT/KR2021/000383 dated Aug. 23, 2021.

* cited by examiner

*Primary Examiner* — Stephen M Gravini
(74) *Attorney, Agent, or Firm* — Ked & Associates

(57) ABSTRACT

A concentrator and hair dryer including a concentrator are provided. The concentrator may include a head having at least one flow path provided therein to enable gas discharged from a gas discharge of the hair dryer to flow therethrough, and a body that extends backward from the head and coupled to a main body of the hair dryer. Accordingly, the concentrator may be securely coupled to the hair dryer to prevent separation and shaking upon use.

20 Claims, 11 Drawing Sheets

CONCENTRATOR AND HAIR DRYER INCLUDING CONCENTRATOR

CROSS-REFERENCE TO RELATED APPLICATION(S)

This application claims priority under 35 U.S.C. § 119 to Korean Application No. 10-2020-0058883, filed in Korea on May 18, 2020 which is hereby incorporated in its entirety by reference as if fully set forth herein.

BACKGROUND

1. Field

A concentrator and a hair dryer including a concentrator are disclosed herein.

2. Background

When a desired amount of moisture is removed from human hair in a wet condition or human hair is styled into a desired shape, a hair dryer that discharges gas through a gas discharge part is employed.

An accessory may be coupled to a hair dryer to provide a user with a gas having a user-desired property. As the accessory is detachably provided, the hair dryer may include a structure that can be coupled to the accessory.

In this regard, Korean Patent Laid-open Gazette No. 10-2019-0040108, which is hereby incorporated by reference, discloses a hair dryer coupled with an accessory that discharges a gas. That is, the accessory may be coupled to the hair dryer in a manner of being fitted into a main body portion.

However, the hair dryer disclosed in Korean Patent Laid-open Gazette No. 10-2019-0040108 fails to disclose a coupling structure that increases coupling power and bearing capacity between the accessory and the main body portion. That is, a user may experience inconvenience in using the hair dryer if the accessory is separated from or shaken in the main body portion.

Therefore, demand for a hair dryer having an accessory strongly coupled to a main body portion upon being used by a user is rising. In particular, as the accessory is not separated from or shaken in the main part, convenience is enhanced when the hair dryer is used. In addition, the user can be prevented from being injured due to the separation of the accessory. Thus, demand for such a hair dryer is increasing.

Besides, many ongoing efforts are made to research and develop a hair dryer that may prevent an accessory from being broken due to separation from a main body portion.

BRIEF DESCRIPTION OF THE DRAWINGS

Embodiments will be described in detail with reference to the following drawings in which like reference numerals refer to like elements, and wherein.

DETAILED DESCRIPTION

Reference will now be made to embodiments, examples of which are illustrated in the accompanying drawings, to facilitate those having ordinary skill in the art to implement the embodiments. The embodiments may be implemented in various kinds of different types and non-limited by the embodiments described herein. Wherever possible, the same or like reference numbers will be used throughout the drawings to refer to the same or like parts, and redundant description of the same components will be omitted.

In the present specification, if one component is mentioned as 'connected to' or 'accessing' another component, the former component may be connected to accesses the latter component in direct. Yet, it is understood that a different component may be present in-between. On the other hand, if one component is mentioned as 'directly connected to' or 'directly accessing' another component, it is understood that a different component may is not present in-between.

Terms used herein are used to describe a specific embodiment only but have no intention to limit the embodiment.

Singular expression may include plural expressions unless having a clear meaning in the context.

Such terminology as 'include', 'have' and the like intends to designate that a feature, a number, a step, an operation, a component, a part or a combination thereof disclosed in the specification exists and should be understood as not excluding possibility of existence or addition of at least one or more features, numbers, steps, operations, components, parts or combinations thereof.

In addition, the term 'and/or' includes a combination of a plurality of disclosed entries or a prescribed one of a plurality of the disclosed entries. For example, 'A or B' may include 'A', 'B', or 'both A and B'.

Figure 1:
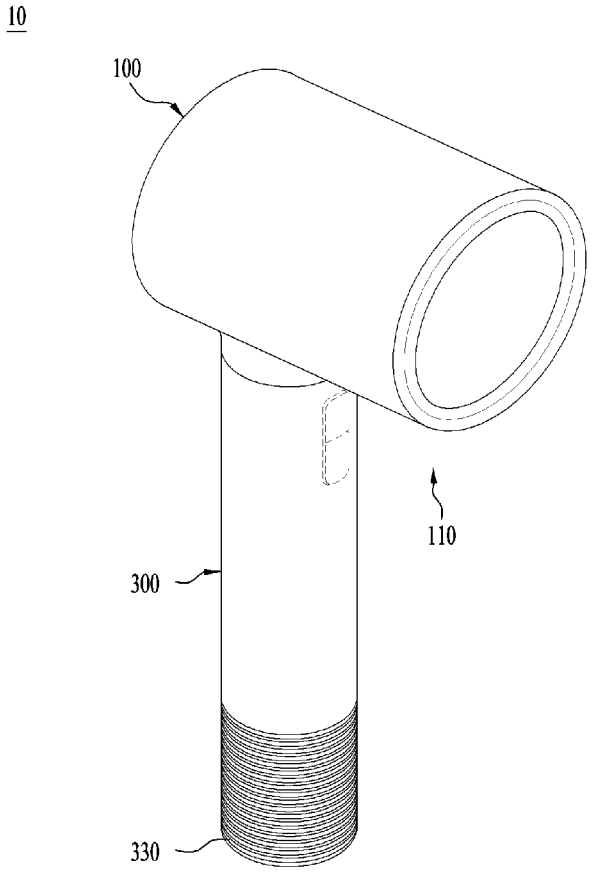
FIG. 1 is a schematic diagram showing a hair dryer from which a concentrator is separated according to an embodiment.
Figure 2:
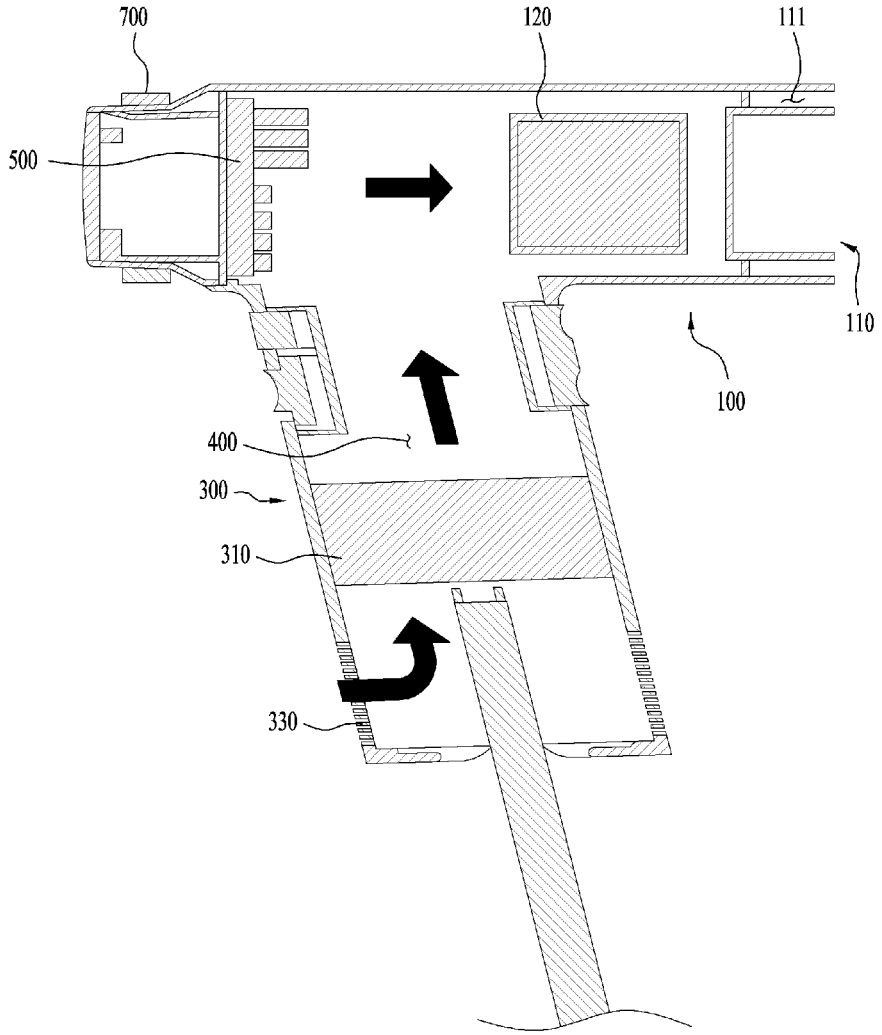
FIG. 2 is a schematic diagram showing an inner cross-section of the hair dryer shown in FIG. 1.

FIG. 1 is a schematic diagram showing a hair dryer from which a concentrator is separated according to an embodiment. FIG. 2 is a schematic diagram showing an inner cross-section of the hair dryer shown in FIG. 1. As shown in FIG. 1 and FIG. 2, a hair dryer 10 according to an embodiment may include a main body portion (main body) 100, a handle part (handle) 300 and a gas discharge part (gas discharge) 110.

The main body portion 100, as shown in FIG. 2, may include a gas flow path 400 formed therein so that gas may flow through the gas flow path 400, and may be provided with the gas discharge part 110 from which the gas may be discharged externally. The main body portion 100 may be configured in a manner of extending in a frontward-rearward direction and have various cross-sectional shapes, such as a circular shape, and a polygonal shape, for example, when viewed in the frontward direction.

Herein, definitions of front, rear, left, right, top, and bottom may be made centering on the main body portion 100. For example, referring to FIG. 2, the gas discharge part 110 may be provided to or at a front side of the main body portion 100, and the handle part 300 may be configured in a manner of extending downward roughly from the main body portion 100.

A gas flowing through an inside of the main body portion 100 may flow in through gas intake part 330 which may be provided to or in the main body portion 100 or the handle part 300. If the gas intake part 330 is provided to the handle part 300, the gas flow path 400 may be formed in a manner of extending to the main body portion 100 from the handle part 300. That is, the gas flow path 400 may be formed to extend from the gas intake part 330 to the gas discharge part 110.

A gas may flow in from outside through the gas intake part 330 provided to or in the main body portion 100 or the handle part 300. The gas flowing inside may flow along the gas flow path 400 and may then be discharged externally through the gas discharge part 110 provided to the main body portion 100.

The handle part 300 may extend from the main body portion 100. The handle part 300 may extend downward from the main body portion 100, as shown in FIG. 1 and FIG. 2. The handle part 300 may be integrally formed with the main body portion 100. Alternatively, the handle part 300 may be separately manufactured and then coupled to the main body portion 100.

In a case that the handle part 300 is separately manufactured and then coupled to the main body portion 100, the handle part 300 may be configured in a manner that a lengthwise direction with respect to the main body portion 100 is fixed or variable. For example, the handle part 300 may be coupled to the main body portion 100 with a hinge coupling part (hinge) so that the lengthwise direction of the handle part 300 is variable, that is, bendable with respect to the main body portion 100.

The handle part 300 may be a portion held in a user's hand, thereby having a shape to enhance convenience of a grip. An extended direction of the handle part 300 may be variable. For clarity of description, an extended direction of the handle part 300 from the main part body portion 100 may be described as a downward direction.

Referring to FIG. 2, the hair dryer according to an embodiment of may include a fan unit (fan) 310 configured to enable a gas to flow and adjust a speed of a discharged gas discharged through the gas discharge part 110. The fan unit 310 may be disposed in the gas flow path 400 to enable a gas to flow and may be provided within the main body portion 100 or the handle part 300. For example, if the gas intake part 330 is disposed on or in the handle part 300, the gas flow path 400 may extend from the gas intake part 330 of the handle part 300 to the gas discharge part 110 of the main body portion 100 and the fan unit 310 may be disposed on or in the gas flow path 400 located at or in the handle part 300.

A temperature control unit (controller) 120 configured to control a temperature of a discharge gas may be provided within the main body portion 100. The temperature control unit 120 provided within the main body portion 100 is schematically shown in FIG. 2.

Various types of the temperature control unit 120 may be employed. For example, a gas may be heated by generating heat in a manner of applying a current to a resistor of a coil type.

The resistor of the temperature control unit 120 may not be a coil type. For example, a gas may be heated using a thermoelement, for example. Thus, various methods of controlling a temperature of a gas may be employed.

An operating system of a hair dryer according to an embodiment is schematically described together with a gas flow hereinafter.

First, a user may manipulate a power button disposed on the main body portion 100 or the handle part 300. Once the power button is turned on, the fan unit 310 may be activated so that gas flows into the hair dryer through the gas intake part 330.

The gas flowing through the gas intake part 330 may flow along the gas flow path 400 due to the fan unit 310 toward the gas discharge part 110. Hence, the discharged gas may be discharged from the gas discharge part 110, thereby being provided to the user.

In doing so, the gas in the gas flow path 400 may have a flow speed controllable by the fan unit 310 and a temperature controllable by the temperature control unit 120. An operating state may be controlled by the fan unit 310 and the temperature control unit 120 in response to user manipulation of a manipulating part 500, or may be automatically performed according to an operation mode preset or predetermined for a controller 700.

Figure 3A:
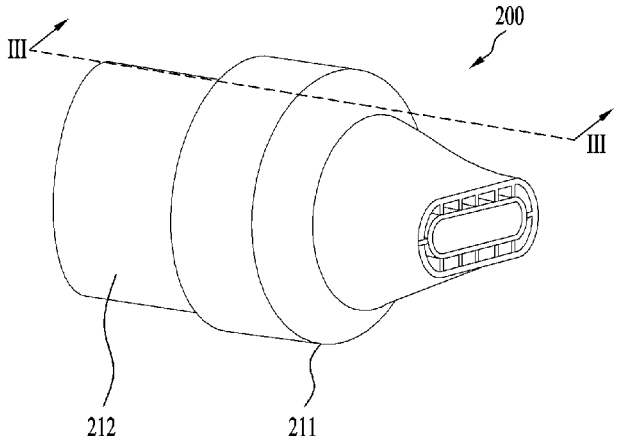
FIGS. 3A-3B are schematic diagrams showing a concentrator according to an embodiment, FIG. 3B being a cross-sectional view taken along line III-III of FIG. 3A.
Figure 3B:
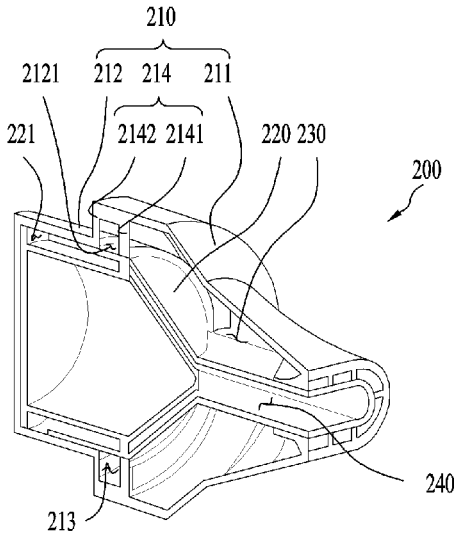

FIG. 3 is a schematic diagram showing a concentrator according to an embodiment. Referring to FIGS. 1 to 3, the hair dryer according to an embodiment may include a concentrator 200 detachably coupled to the main body portion 100.

The main body portion 100 may have the gas discharge part 110 provided at the front side to discharge a gas externally. The concentrator 200 may be coupled to the main body portion 100 to face the gas discharge part 110, thereby receiving the gas discharged from the gas discharge part 110 and then discharging it externally.

The concentrator 200 may include an outer case 210 forming an exterior of the concentrator 200. The outer case 210 may have first and second flow paths 230 and 240 provided therein so that the gas discharged from the gas discharge part 110 may flow through the first and second flow paths 230 and 240.

The concentrator 200 may include a flow path selecting part (selector) 220 configured to have a variable position within the outer case 210. The flow path selecting part 220 may have the first flow path 230 provided in a space between the flow path selecting part 220 and the outer case 210. Moreover, the flow path selecting part 220 may have the second flow path 240 provided inside of the flow path selecting part 220. Thus, depending on the position of the flow path selecting part 220, the gas discharged from the gas discharge part 110 may be discharged externally along one of the first flow path 230 and the second flow path 240.

The outer case 210 may include a head part (head) 211 coupled to an outer wall of the main body portion 100. A body part (body) 212 may be configured in a manner of being spaced apart from an inner surface of the head part 211. The body part 212 may be configured to receive the flow path selecting part 220 therein. The flow path selecting part 220 may be configured to have the variable position within the body part 212.

The body part 212 may be provided with a space for receiving the flow path selecting part 220 therein. More particularly, the body part 212 may be located at a rear of a center of the head part 211. Thus, the body part 212 may form a space for varying the position of the flow path selecting part 220.

For example, as a front side of the body part 212 is open, the flow path selecting part 220 may be inserted therein. A rear side of the body part 212 may be open or closed.

The rear side of the body part 212 may be closed. If the rear side of the body part 212 is closed, the flow path selecting part 220 may be moved backward until the rear side of the flow path selecting part 220 contacts the rear side of the body part 212. That is, a space for moving the flow path selecting part 220 may be formed from the front side of the body part 212 to the rear side of the body part 212.

In addition, if the rear side of the body part 212 is closed, the flow path selecting part 220 may have a rear side distance that is set for being movable in the body part 212 to a maximum without a separate configuration. Moreover, as the flow path selecting part 220 contacts an inner surface of the body part 212 including the rear side of the body part 212 upon a user's use, shaking and separation may be prevented as much as possible.

Further, if the rear side of the body part 220 is closed, backward movement of the flow path selecting part 220 may be restricted by air located between the body part 212 and the flow path selecting part 220. To prevent this, an outer surface of the flow path selecting part 220 and the inner surface of the body part 212 may be spaced apart from each other by a predetermined distance. A separate air discharge hole (not shown) to discharge the air between the rear side of the body part 212 and the flow path selecting part 220 outside of the body part 212 may be provided to the flow path selecting part 220.

When the rear side of the body part 212 is open (not shown in the drawing), if the flow path selecting part 220 is moved backward in the body part 212, a separate stopper may be necessary. Thus, a separate air discharge hole may not be provided between the flow path selecting part 220 and the body part 212.

Whether to open or close the rear side of the body part 212 may be selected depending on a coupling relationship between the concentrator 200 and the body part 100 and use requirements.

Figure 4:
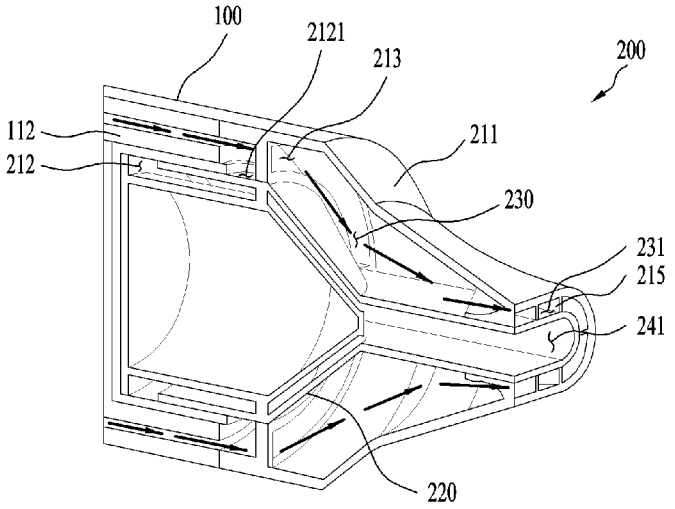
FIG. 4 is a schematic diagram showing gas flowing through a first flow path according to an embodiment.

FIG. 4 is a schematic diagram showing gas flow through a first flow path according to an embodiment. As the second flow path 240 is closed, the gas discharged from the gas discharge part 110 may flow through the first flow path 230 so as to be discharged externally.

More particularly, a flow path selecting space 213 may be formed between the head part 211 and the body part 212. The flow path selecting space 213 may be located to face the gas discharge part 110.

The gas discharged from the gas discharge part 110 may flow into the flow path selecting space 213. The gas having flown into the flow path selecting space 213 may be guided to the first flow path 230 or the second flow path 240.

In addition, the flow path selecting part 220 may be moved forward or backward within the body part 212. The flow path selecting part 220 may be moved to open one of the first and second flow paths 230 and 240 and close the other. That is, the gas discharged from the gas discharge part 110 may pass through the flow path selecting space 213 and may then be discharged externally along one of the first and second flow paths 230 and 240.

The first flow path 230 may be formed by the inner surface of the head part 211 and the outer surface of the flow path selecting part 220. That is, the gas discharged from the gas discharge part 110 may pass through the flow path selecting space 213 and then flow into the first flow path 230.

A body flow hole 2121 facing the flow path selecting space 213 may be formed in the body part 212. Moreover, the flow path selecting part 220 may be provided with a flow path selection flow hole 221 communicating with the second flow path 240.

Referring to FIG. 4, the flow path selecting part 220 is movable backward. If the rear side of the body part 212 is closed, as shown in FIG. 4, the flow path selecting part 220 may be moved backward until the rear side of the body part 212 and the rear side of the flow path selecting part 220 contact with each other.

As the flow path selecting part 220 is moved backward, the flow path selection flow hole 221 may be spaced apart from the body flow hole 2121 backward.

The body flow hole 2121 may be closed by the outer surface of the flow path selecting part 220. In addition, the flow path selection flow hole 221 may be closed by the inner surface of the body part 212.

Thus, the second flow path 240 may be closed. While the second flow path 240 is closed, the flow path selecting part 220 may be spaced apart from the inner surface of the head part 211 backward. Therefore, the first flow path 230 may maintain an open state.

The gas discharged from the gas discharge part 110 may flow into the flow path selecting space 213. The gas having flown into the flow path selecting space 213 may be prevented from flowing into the second flow path 240 as the body flow hole 2121 is closed.

In addition, the gas having flown into the flow path selecting space 213 may be guided to the first flow path 230. While the body flow hole 2121 is closed, the flow path selecting part 220 may be provided in a manner of being spaced apart from the inner surface of the head part 211. That is, the first flow path 230 may be open.

Thus, the gas having flown into the first flow path 230 after passing through the flow path selecting space 213 may be discharged externally along the first flow path 230. Accordingly, a user may use the gas discharged externally along the first flow path 230. The first flow path 230 may be configured in a manner that the gas passing through the first flow path 230 may have a user-preferred property.

A diameter of the first flow path 230 may be configured to be constant, decrease, or increase toward an outside. Alternatively, a diameter of the first flow path 230 may be configured to differ per specific position.

For example, a diameter of the first flow path 230 may decrease uniformly toward an outside. The smaller the diameter becomes, the faster the gas flowing through the first flow path 230 may move.

If a diameter decrease rate of the first flow path 230 is smaller than that of the second flow path 240, a gas externally flowing out through the first flow path 230 is less concentrated than a gas externally flowing out through the second flow path 240, thereby having a relatively smooth gas flow. Therefore, the gas externally flowing out through the first flow path 230 may give a relatively soft tactile impression to a user in comparison to the gas externally flowing out through the second flow path 240.

In addition, a separate filter (not shown) may be provided within the first flow path 230. The filter may remove particles or debris from the gas before the gas is discharged externally through the first flow path 230, thereby giving a refreshed feeling to a user.

A separate temperature control member (not shown) may be provided within the first flow path 230. The temperature control member may control a temperature of the externally discharged gas together with the temperature control unit 120.

That is, a user may be provided with a gas having a property according to user's preference owing to the separately provided configuration. As a user may selectively use the first flow path 230 or the second flow path 240, the first flow path 230 and the second flow path 240 may be configured to have different properties, respectively.

Figure 5:
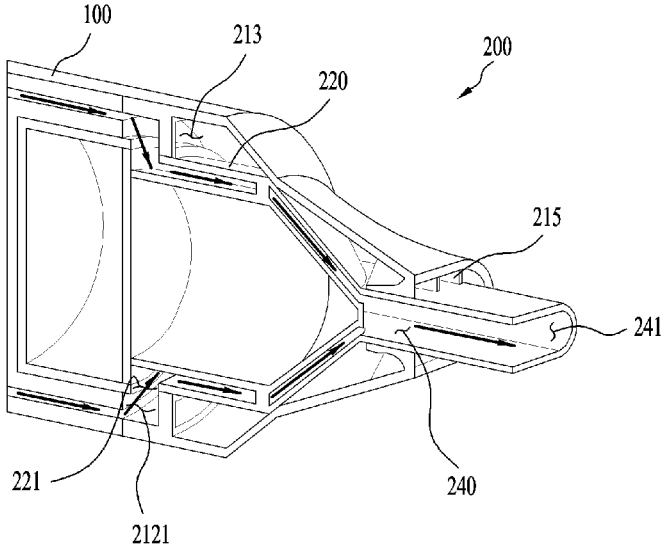
FIG. 5 is a schematic diagram showing gas flowing through a second flow path according to an embodiment.

FIG. 5 is a schematic diagram showing gas flowing through a second flow path according to an embodiment. Referring to FIG. 5, regarding the hair dryer according to an embodiment, the first flow path 230 may be closed, and the gas discharged from the gas discharge part 110 may be externally discharged by flowing through the second flow path 240.

More particularly, the flow path selecting space 213 may be formed between the head part 211 and the body part 212. The flow path selecting space 213 may be located to face the gas discharge part 110.

The gas discharged from the gas discharge part 110 may flow into the flow path selecting space 213. The gas having flown into the flow path selecting space 213 may be guided to the first flow path 230 or the second flow path 240.

In addition, the flow path selecting part 220 may be moved forward or backward within the body part 212. The flow path selecting part 220 may be moved to open one of the first and second flow paths 230 and 240 and close the other. That is, the gas discharged from the gas discharge part 110 may pass through the flow path selecting space 213 and may then be discharged externally along one of the first and second flow paths 230 and 240.

The first flow path 230 may be formed by the inner surface of the head part 211 and the outer surface of the flow path selecting part 220. That is, the gas discharged from the gas discharge part 110 may pass through the flow path selecting space 213 and then flow into the first flow path 230.

The body flow hole 2121 facing the flow path selecting space 213 may be formed in the body part 212. Moreover, the flow path selecting part 220 may be provided with the flow path selection flow hole 221 communicating with the second flow path 240.

Referring to FIG. 5, the flow path selecting part 220 is movable forward from the body part 212. As the flow path selecting part 220 is moved forward, the body flow hole 2121 and the flow path selection flow hole 221 may communicate with each other.

While the body flow hole 2121 and the flow path selection flow hole 221 communicate with each other, the flow path selecting part 220 may contact the inner surface of the head part 211. Thus, the second flow path 240 may be open. While the second flow path 240 is open, the first flow path 230 may be closed by the outer surface of the flow path selecting part 220.

More particularly, as the flow path selecting part 220 is moved forward, the flow path selecting space 213, the body flow hole 2121, the flow path selecting part 220 and the second flow path 240 may communicate with each other. In addition, while the second flow path 240 is open, the outer surface of the flow path selecting part 220 contacts the inner surface of the head part 211, thereby closing the first flow path 230. That is, the gas, which has flown into the first flow path 230 after passing through the flow path selecting space 213, may be prevented from being discharged externally along the first flow path 230 owing to the outer surface of the flow path selecting part 220.

The gas, which has flown into the first flow path 230 after passing through the flow path selecting space 213, may be externally discharged through the second flow path 240. That is, the gas discharged from the gas discharge part 110 may be externally discharged along the second flow path 240 only.

Accordingly, a user may use the gas discharged externally along the second flow path 240. The second flow path 240 may be configured in a manner that the gas passing through the second flow path 240 may have a user-preferred property.

That is, a diameter of the second flow path 240 may be configured to be constant, decrease, or increase toward an outside. Alternatively, a diameter of the second flow path 240 may be configured to differ per specific position.

For example, a diameter of the second flow path 240 may decrease uniformly toward an outside. The smaller the diameter becomes, the faster the gas flowing through the second flow path 240 may flow.

If a diameter decrease rate of the second flow path 240 is greater than that of the first flow path 230, a speed of a gas externally flowing out through the second flow path 240 may be greater than that of a gas externally flowing out through the first flow path 230. Therefore, the gas externally flowing out through the second flow path 240 may give a relatively strong tactile impression to a user in comparison to the gas externally flowing out through the first flow path 230.

In addition, a separate filter (not shown) may be provided within the second flow path 240. The filter may remove particles or debris from the gas before the gas is discharged externally through the second flow path 240, thereby giving a refreshed feeling to a user.

A separate temperature control member (not shown) may be provided within the second flow path 240. The temperature control member may control a temperature of the externally discharged gas together with the temperature control unit 120. That is, a user may be provided with a gas having a property according to a user's preference owing to the separately provided configuration. As a user may selectively use the first flow path 230 or the second flow path 240, the first flow path 230 and the second flow path 240 may be configured to have different properties, respectively.

Hereinafter, a method of moving the flow path selecting part 220 in the body part 212 according to an embodiment is described.

A user may use a hand to move the flow path selecting part 220 backward or forward within the body part 212. The user may move the flow path selecting part 220 forward in a manner of inserting a hand in a hole provided to or at a front side tip of the flow path selecting part 220. That is, the user may move the flow path selecting part 220 forward by applying tension to the flow path selecting part 220.

On the contrary, the user may move the flow path selecting part 220 backward by applying a pressure to a front side end portion or end of the flow path selecting part 220. That is, the user may move the flow path selecting part 220 backward by applying a force in the rearward direction of the flow path selecting part 220 using a hand.

A spring (not shown) may be provided between the flow path selecting part 220 and a rear side of the body part 212. The user may move the flow path selecting part 220 forward or backward using the spring.

That is, the user may apply a force to the flow path selecting part 220, thereby compressing the spring. While the spring is compressed, the flow path selecting part 220 may be fixed in a manner of being coupled to the body part 212 or the head part 211. The user may use the gas discharged through the first flow path 230.

The user may decouple the spring from the body part 21 or the head part 211. In this case, the spring applies a force to the rear side of the flow path selecting part 220, thereby moving the flow path selecting part 220 forward.

There may be various methods of moving the flow path selecting part 220 within the body part 212. Hence, the method of moving the flow path selecting part 220 may be determined by considering an extent of a coupling power between the flow path selecting part 220 and the body part 212, and the inner space of the body part 212, for example.

Figure 6:
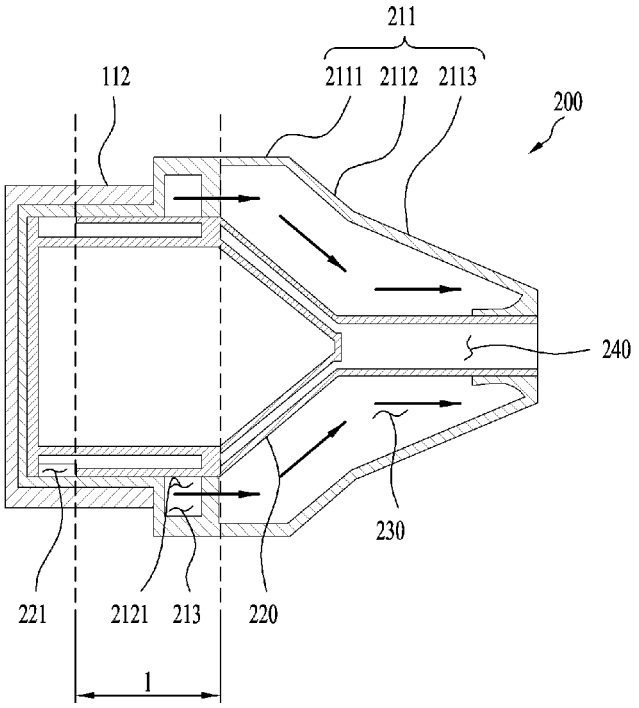
FIG. 6 is a schematic diagram showing a position of a flow path selecting part when gas flows through the first flow path according to an embodiment.

FIG. 6 is a schematic diagram showing a position of a flow path selecting part when gas flows through a first flow path according to an embodiment. The following description will be made with reference to FIG. 6. The description redundant with FIG. 4 will be omitted. The same substance described above is not omitted entirely but may be also re-described in part for clarity of description and clear understanding of the disclosure. In addition, the omitted substance should not be excluded or interpreted independently.

Referring to FIG. 6, regarding the hair dryer according to an embodiment, as described above, the flow path selecting part 220 may be moved backward so as to contact the rear side of the body part 212. In this case, the gas discharged from the gas discharge part 110 may be discharged externally through the first flow path 230 only.

The body flow hole 2121 may be formed in or at a front end portion or end of the body part 212. The flow path selection flow hole 221 may be formed in or at a rear end portion or end of the flow path selecting part 220. Thus, the body flow hole 2121 may be maximally spaced apart from the flow path selection flow hole 221 at a specific position of the flow path selecting part 220 rather than a case of being provided to another portion of the body part 212.

Moreover, the flow path selection flow hole 221 may be maximally spaced apart from the body flow hole 2121 at a specific position of the flow path selecting part 220 rather than a case of being provided to another portion of the flow path selecting part 220. That is, when the flow path selecting part 220 contacts the rear side of the body part 212, the body flow hole 2121 and the flow path selection flow hole 221 may be maximally spaced apart a distance from each other. That is, a distance from a front end portion or end of the flow path selection flow hole 221 to a front end portion or end of the body part 212 may be maximum.

Thus, as the flow path selecting part 220 is moved backward to open the first flow path 230 while closing the second flow path 240, it may be easy to secure a cross-sectional area to enable the gas discharged from the gas discharge part 110 to pass through the first flow path 230. The flow path selecting part 220 may open the first flow path 230 to the maximum while closing the second flow path 240.

The flow path selecting part 220 may be maximally inserted into the body part 212 wile maximally opening the first flow path 230, thereby increasing the coupling power with the body part 212. Thus, when the gas is externally discharged in a manner of flowing through the first flow path 230 only, it is able to secure a space enough for the gas to flow. As a sufficient space is secured within the first flow path 230, a separate component, such as a filter, may be provided.

That is, the inner space of the first flow path 230 may be utilized efficiently. As the coupling power between the flow path selecting part 220 and the body part 212 is increased, the flow path selecting part 220 may be prevented from being separated from the body part 212 when used by a user.

Figure 7:
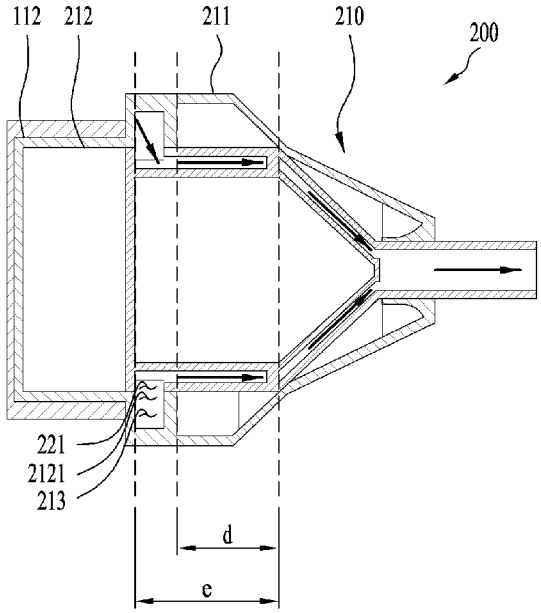
FIG. 7 is a schematic diagram showing a position of a flow path selecting part when gas flows through the second flow path according to an embodiment.

FIG. 7 is a schematic diagram showing a position of the flow path selecting part when gas flows through the second flow path according to an embodiment. The following description will be made with reference to FIG. 7. The description redundant with FIG. 5 will be omitted. The same substance described above is not omitted entirely but may be also re-described in part for clarity of description and clear understanding of the disclosure. In addition, the omitted substance should not be excluded or interpreted independently.

Referring to FIG. 7, regarding the hair dryer according to an embodiment, as described above, the flow path selecting part 220 may be moved forward so as to contact the inner surface of the head part 211. In this case, the gas discharged from the gas discharge part 110 may be discharged externally through the second flow path 240 only.

The body flow hole 2121 may be formed in the front end portion of the body part 212. The flow path selection flow hole 221 may be formed in the rear end portion of the flow path selecting part 220. When the flow path selecting part 220 is moved forward while contacting the rear side of the body part 212, the body flow hole 2121 may maintain a closed state by the outer surface of the flow path selecting part 220.

That is, when the flow path selecting part 220 is maximally moved forward within the body part 212, the body flow hole 2121 may overlap with the flow path selection flow hole 221. The body flow hole 2121 and the flow path selection flow hole 221 may communicate with each other.

Regarding the body flow hole 212, while the flow path selecting part 220 is maximally moved forward within the body part 212, the outer surface of the flow path selecting part 220 may contact the inner surface of the head part 211. On the other hand, a portion of the gas flowing into the flow path selecting space 213 may flow into the second flow path 240 by passing through the body flow hole 2121 and the flow path selection flow hole 221 in order.

The gas prevented from being externally discharged along the first flow path 230 may flow into the second flow path 240 by passing through the body flow hole 2121 and the flow path selection flow hole 221 in order. That is, the gas having flown into the flow path selecting space 213 may be externally discharged along the second flow path 240 only.

A forward length of the body flow hole 2121 may be set equal to that of the flow path selection flow hole 221. That is, when the flow path selecting part 220 contacts the inner surface of the head part 211, the inner surface of the flow path selecting part 220 provided with the flow path selection flow hole 221 and the inner surface of the body part 212 provided with the body flow hole 212 may form a continuous surface.

The continuous surface formed by the inner surface of the flow path selecting part 220 provided with the flow path selection flow hole 221 and the inner surface of the body part 212 provided with the body flow hole 212 may reduce flowing resistance when a gas located in the flow path selecting space 213 flows into the second flow path 240. Accordingly, in controlling a speed of the gas discharged externally through the second flow path 240, a power required to operate the fan unit 310 may be reduced.

The outer case 210 may include a connecting part or portion 214 that connects the head part 211 and the body part 212 together. The connecting part 214 may include a first connecting part or portion 2141 connected from the body part 212 to the head part 211, and a second connecting part or portion 2142 spaced apart backward from the first connecting part 2141.

The second connecting part 2142 may extend from the body part 212 to the head part 211. That is, the first connecting part 2141 and the second connecting part 2142 may connect the body part 212 and the head part 211 together. For structural safety, each of the first connecting part 2141 and the second connecting part 2142 may include a bar in a flat shape.

The body part 212 may include the body flow hole 2121 extending between the first connecting part 2141 and the second connecting part 2142 along a circumferential direction of the body part 212. That is, as the first connecting part 2141 and the second connecting part 2142 are provided, the body part 212 may include the body flow hole 2121 provided in a manner of perforating the body part 212 entirely along the circumference of the body part 212. Accordingly, when the second flow path 240 is open, the body flow hole 2121 may easily secure a flowing area of gas flowing into the second flow path 240 in the flow path selecting space 213.

The first connecting part 2141 may extend from an end portion or end of the body part 21 to the head part 211. As the body flow hole 2121 is located at the end portion of the first connecting part 2141, it may be provided to or at the front side of the body part 212.

The effect that the body flow hole 2121 is provided to the front side of the body part 212 has the same effect as described above. Further, if the second flow path 240 is open, the body flow hole 2121 may easily secure a flowing area of gas flowing into the second flow path 240 in the flow path selecting space 213.

Referring to FIG. 5 and FIG. 6, when the flow path selecting part 220 contacts the rear side of the body part 212, a length from a front end or end portion of the flow path selection flow hole 221 to the front end portion of the body part 212 may be referred to as a first length l hereinafter.

When the flow path selecting part 220 contacts the inner surface of the head part 211, the first length l may be equal to a distance from the front end portion of the flow path selection flow hole 221 to a contact point between the flow path selecting part 220 and the head part 211. When the flow path selecting part 220 contacts the inner surface of the head part 211, a length from the front end portion of the body part 212 to a point at which the flow path selecting part 220 contacts the inner surface of the head part 211 may be referred to as a second length d hereinafter. The first length l may be set smaller than the second length d.

When the flow path selecting part 220 contacts the inner surface of the head part 211, a length from the rear end portion of the body flow hole 2121 to a point at which the flow path selecting part 220 contacts the inner surface of the head part 211 may be referred to as a third length e hereinafter. The third length e may be set smaller than the first length l.

The third length e may be set greater than the first length l or the second length d and the first length l may be set greater than the second length d. Thus, as the flow path selecting part 220 is moved in the body part 212, the gas discharged from the gas discharge part 110 may be externally discharged along one of the first flow path 230 and the second flow path 240. The first length l, the second length d, and the third length e are provided for clarity of description instead of indicating the order.

The head part 211 may include a first head part 2111 coupled to the outer wall of the main body portion 100. The first head part 2111 may have a uniform diameter. Thus, a space for moving the flow path selecting part 220 may be formed within the first head part 2111. That is, the first head part 2111 may secure a sufficient space for moving the flow path selecting part 220 therein in a case of having a uniform diameter rather than having a diameter decreasing toward the front side.

As the first flow path 230 is formed between the outer surface of the flow path selecting part 220 and the inner surface of the head part 211, the first head part 2111 may have a uniform diameter. Thus, the first flow path 230 may secure a sufficient inner space. Accordingly, as the moving space of the flow path selecting part 220 is sufficiently secured, the head part 211 may improve inner space utilization efficiency of the first flow path 230.

Although the drawing shows that the diameter of the first head part 2111 is uniform, the diameter of the first head part 2111 may increase or decrease toward a front side in consideration of the inner space of the first flow path 230, a shape of the flow path selecting part 220, and a property of gas configured to pass through the first flow path 230, for example. That is, the diameter of the first head part 2111 should not be restrictively interpreted as uniform.

The head part 211 may include a second head part 2112 that extends from the first head part 2111. The second head part 2112 may be configured to have a diameter decreasing toward a front side. That is, in a case that the diameter of the first head part 2111 is configured uniform, the diameter of the second head part 2112 may be configured to decrease so that the flow path selecting part 220 may contact an inner surface of the second head part 2112 by being moved forward.

Moreover, when the gas discharged from the gas discharge part 110 passes through the first flow path 230 provided within the second head part 2112, the corresponding gas flow may be concentrated at a center of the first flow path 230. Accordingly, a user may effectively dry hair using the gas passing through the first flow path 230.

The head part 211 may include a third head part 2113 that extends from the second head part 2122. The third head part 2113 may have a diameter decreasing rate smaller than that of the second head part 2112. That is, the third head part 2113 may decrease an extent that a flow of a gas having passed through the second head part 2112 is concentrated at the center of the first flow path 230. Thus, the third head part 2113 may be advantageous in externally discharging a gas having a property smoother than a gas externally discharged along the second flow path 240.

As a diameter decrease rate of the third head part 2113 is set smaller than that of the second head part 2112, the head part 211 may have a length longer than that of a case that the diameter decrease rate of the third head part 2113 is set greater than that of the second head part 2112. Thus, as the length of the first flow path 230 is set longer, the inner space of the first flow path 230 may be efficiently utilized to provide a gas having a property desired by a user.

The flow path selecting part 220 may be moved forward within the body part 212 so as to contact an inner surface of the third head part 2113. That is, the flow path selecting part 220 may be moved forward within the body part 212 and contact an inner surface of the second or third head part 2112 or 2113, thereby closing the first flow path 230.

A contact point between the flow path selecting part 220 and the head part 211 may be selected to enable a function of selecting the first flow path 230 or the second flow path 240 selectively depending on movement of the flow path selecting part 220 in consideration of a shape and size of the head part 211, and a shape and size of the body part 212, a shape and size of the flow path selecting part 220, for example.

Figure 8A:
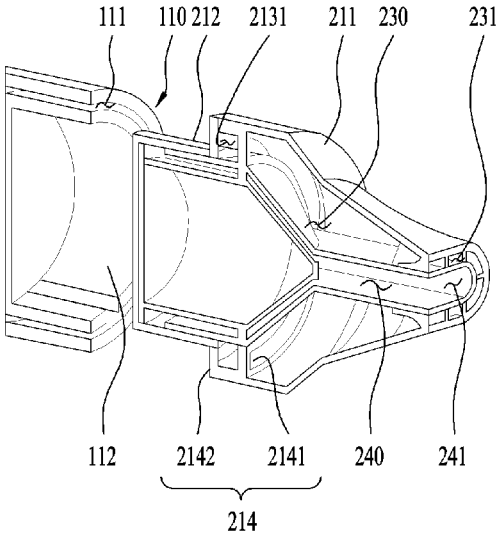
FIGS. 8A-8B are schematic diagrams showing coupling between a concentrator and a main body portion according to an embodiment.
Figure 8B:
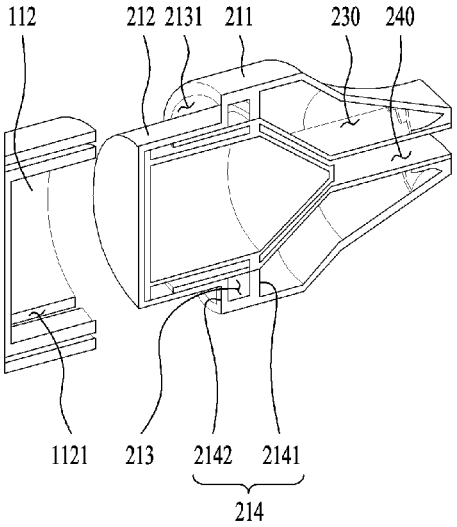

FIGS. 8A-8B are diagrams showing coupling between a concentrator and a main body portion according to an embodiment. More specifically, FIG. 8A shows concentrator 200 coupled in a direction of viewing an inner surface of the main body portion 100, and FIG. 8B shows the concentrator 200 coupled in a direction of viewing an outer surface of the concentrator 200.

Referring to FIG. 8A and FIG. 8B, regarding the hair dryer according to an embodiment, the concentrator 200 may be coupled with the main body portion 100. More particularly, the main body portion 100 may include the gas discharge part 110 provided to or at the front side to discharge a gas externally. The concentrator 200 may be detachably coupled to the main body portion 100.

The concentrator 200 may receive a gas discharged from the gas discharge part 110 and then discharge it externally. The concentrator 200 may include the head part 211 provided with a flow path inside for enabling the gas discharged from the gas discharge part 110 to flow therein. At least one flow path may be provided within the head part 211.

The concentrator 200 may include the body part 212 provided in a manner of being extended backward from the head part 211. The body part 212 may be coupled with the main body portion 100.

The gas discharge part 110 may include a receiving part or portion 112 provided to or at a center of the gas discharge part 110. The receiving part 112 may be configured to receive the body part 212 therein.

The main body portion 100 may further include the receiving part 112 provided to or at a center of the main body portion 100 and configured to receive the body part 212 therein. The body part 212 may be coupled by being inserted in the receiving part 112.

An outer wall of the head part 211 may closely adhere to the outer wall of the main body portion 100. Thus, a coupling power between the body part 212 and the receiving part 112 may be increased. Accordingly, a coupling power between the main body portion 100 and the concentrator 200 may be increased.

When a user uses the air dryer, the concentrator 200 may be prevented from being separated from the main body portion 100 or shaken. Therefore, a user's use convenience may be enhanced.

A front end portion or end of the receiving part 112 may be provided at a same location as a front end portion or end of the main body portion 100 or within the main body portion 100 rather than the front end portion of the main body portion 100. Accordingly, while the concentrator 200 is not attached, the receiving part 112 may be prevented from contacting an external environment, whereby breakage may be prevented.

As the body part 212 is received in the receiving part 112, the concentrator 200 may be coupled to the main body portion 100. More particularly, a front side of the receiving part 112 may be open to receive the body part 212 therein.

Moreover, a rear side of the receiving part 112 may be closed. The body part 212 may be received in the receiving part 112 in a manner that the rear side of the body part 212 contacts the rear side of the receiving part 112. An outer surface of the body part 212 may be coupled to the entire inner surface of the receiving part 112.

Accordingly, as the body part 212 maximally secures a contact area with the receiving part 112, a coupling power may be increased. If a user moves or shakes the hair dryer 10 in using the hair dryer 10, the concentrator 200 may be maximally prevented from being shaken or separated from the main body portion 100. When a user uses the hair dryer 10, as the concentrator 200 is prevented from being separated from the main body portion 100, the user may be prevented from getting injured by the concentrator 200 that is heated by a hot gas.

The main body portion 100 may be configured in a hollow cylindrical shape. The receiving part 112 may be configured in a hollow cylindrical shape corresponding to the main body portion 100. A gas discharge hole 111 to discharge gas may be formed between an inner surface of the main body portion 100 and an outer surface of the receiving part 112.

That is, the gas discharge hole 111 may be configured in a ring shape. The main body portion 100 and the receiving part 112 may be configured in cylindrical shapes corresponding to each other, thereby reducing flow resistance of gas flowing through the gas discharge hole 111.

The body part 212 may be configured in a hollow cylindrical shape and inserted in the receiving part 112. As the body part 212 and the receiving part 112 are configured in cylindrical shapes corresponding to each other, a contact area between an outer surface of the body part 212 and an inner surface of the receiving part 112 is increased to enhance coupling power.

In a case that the body part 212 is configured in a cylindrical shape, when a user attaches the concentrator 200 to the main body portion 100, injury caused by contact between the user and the body part 212 may be prevented maximally rather than a case that the body part 212 is configured in a polygonal shape.

A portion of the flow path selecting part 220 received in the body part 212 may be configured in a cylindrical shape. Thus, a contact area between the portion of the flow path selecting part 220, which is received in the body part 212, and the body part 212 is increased, whereby coupling power may be increased.

In addition, the flow path selecting part 220 may be inserted into the body part 212 in a manner of facilitating its movement within the body part 212. That is, the flow path selecting part 220 may have the strong coupling power with the body part 212 and facilitate its movement within the body part 212 as well.

As describe above, the rear side of the receiving part 112 may be closed. The rear side of the body part 212 may be inserted and coupled in a manner that the rear side of the body part 212 contacts the rear side of the receiving part 112.

In this case, by the gas located between the rear side of the receiving part 112 and the rear side of the body part 212, the body part 212 may be restricted from being inserted in the receiving part 112. Therefore, at least one of the receiving part 112 and the body part 212 may be provided with a receiving discharge part or portion 1121 configured to enable a space between the rear side of the receiving part 112 and the body part 212 to communicate with an outside of the receiving part 112.

If the body part 212 is inserted into the receiving part 112, the outer surface of the body part 212 may be inserted and coupled in a manner of contacting the inner surface of the receiving part 112 in order to increase coupling power between the body part 212 and the receiving part 112. The air located between the receiving part 112 and the body part 212 may be restricted from being discharged out of the receiving part 112. The air located between the receiving part 112 and the body part 212 may be compressed by the body part 212.

Eventually, the compressed air may restrict insertion of the body part 212 into the receiving part 112. To prevent this, the receiving discharge part 1121 may be configured in a manner of perforating the receiving part 112 along a direction in which the body part 212 is received in the receiving part 112. When the body part 212 is inserted and coupled to the receiving part 112, the air located between the rear side of the receiving part 112 and the body part 212 may be discharged through the receiving discharge part 1121.

When the insertion and coupling of the body part 212 and the receiving part 112 are completed, the receiving discharge part 1121 may be closed by the outer surface of the body part 212. Therefore, although a user uses the hair dryer 10, the outer surface of the body part 212 may maximally prevent the gas from flowing into the receiving part 112 through the receiving discharge part 1121. That is, flow of gas toward the gas discharge hole 111 may be maintained uniform and turbulence, for example, may be prevented.

As the receiving part 112 is configured to have a long length in the frontward or rearward direction, a contact area of an outer surface of the body part 100 contacting the inner surface of the receiving part 112 may be secured sufficiently.

In this case, the rear side of the body part 212 may be coupled in a manner of being spaced apart from the rear side of the receiving part 112. Owing to the small inserted portion of the body part 212, the air located between the receiving part 112 and the body part 212 may be maximally prevented from being compressed by the body part 212. That is, the receiving part 112 or the body part 212 may not be provided with the receiving discharge part 1121.

A coupling mechanism of the receiving part 112 and the body part 212 may be selected in consideration of a diameter and thickness of the receiving part 112, a diameter and thickness of the body part 21, and a flow speed of the gas discharged from the gas discharge part 110, for example.

The rear side of the receiving part 112 may be open, which is not shown in the drawing. If the rear side of the receiving part 112 is open, a separate stopper may be required when the body part 212 is coupled in a manner of being inserted backward within the receiving part 112. The outer wall of the head part 211 may be coupled to the outer wall of the body part 100, thereby playing a role as a stopper.

If the rear side of the receiving part 112 is open, a separate air discharge hole may not be provided between the flow path selecting part 220 and the body part 212. Whether to open or close the rear side of the receiving part 112 may be selected depending on a coupling relationship and use requirements of the body part 212 and the receiving part 112.

The gas discharge part 110 may include a gas discharge hole 111 provided between the inner surface of the body part 100 and the receiving part 112 to discharge the gas therethrough. The gas discharge hole 111 may be configured to enclose the receiving part 112.

A cross-sectional area of the gas discharge hole 111 may include a difference between a cross-sectional area of the inner surface of the main body portion 100 and a cross-sectional area of an outer diameter of the receiving part 112. Moreover, a length of the gas discharge part 110 may be set equal to that of the receiving part 112. That is, as the receiving part 112 is provided within the main body portion 100, the gas discharged through the gas discharge hole 11 may be accelerated before the gas is discharged.

The receiving part 112 decreases a cross-sectional area of the gas flowing within the main body portion 100 before being discharged, thereby maximally preventing the flow of the gas from being bent toward the center of the main body portion 100. The receiving part 112 may maximally prevent the flow of the gas from being dispersed.

The receiving part 112 may stabilize flow of the gas, whereby the gas discharged from the gas discharge hole 111 may flow into the concentrator 200. The concentrator 200 may include a gas flowing hole 2131 provided between the head part 211 and the body part 212. The gas flowing hole 2131 may be configured to enable the gas discharged from the gas discharge hole 111 to flow into the concentrator 200. The gas flowing hole 2131 may be configured to enclose the body part 212.

The gas flow hole 2131 may be configured to face the gas discharge hole 111. The gas flow hole 2131 may be configured to consistently maintain a stable flow of gas flowing in from the gas discharge hole 111.

Accordingly, the flow of the gas may be maximally prevented from being bent in a centerwise direction of the main body portion 110 or the outer case 210 right until the gas is discharged externally, whereby the flow of the gas may be maintained stably. Moreover, the flow of the gas is maximally prevented from being dispersed in the centerwise direction of the main body portion 110 or the outer case 210 right until the gas is discharged externally, whereby the flow of the gas may be maintained stably.

The outer wall of the head part 211 may be coupled with the outer wall of the main body portion 100. The outer surface of the head part 211 and the outer surface of the main body portion 100 may form a continuous surface. Moreover, the inner surface of the head part 211 and the inner surface of the main body portion 100 may form a continuous surface.

The outer wall of the head part 211 may be coupled with the outer wall of the main body portion 100, thereby maximally preventing gas discharged from the gas discharge hole 111 from leaking externally through a portion of coupling the head part 211 and the main body portion 100 together. As the outer surface of the head part 211 and the outer surface of the main body portion 100 form a continuous surface together, the outer surface of the head part 211 and the outer surface of the main body portion 100 may be prevented from being projected in a direction opposite to the center of the main body portion 100 and a direction opposite to the center of the head part 211, respectively. Accordingly, when the hair dryer is used, the outer surface of the head part 211 and the outer surface of the main body portion 100 may be maximally prevented from being broken. As the inner surface of the head part 211 and the inner surface of the main body portion 100 form a continuous surface together, when gas discharged from the gas discharge hole 111 flows into the gas flowing hole 2131, flow resistance may be reduced.

The concentrator 200 may include the connecting part 214 that connects the head part 211 and the body part 212 together. The connecting part 214 may be supported in the frontward direction by the outer wall of the receiving part 112.

The connecting part 214 may be coupled to be connected to the outer wall of the receiving part 112. The connecting part 214 may be configured as a bar in a flat shape, thereby connecting the head part 211 to the body part 212. Accordingly, the connecting part 214 provides a bearing capacity to the receiving part 112, thereby maximally preventing the concentrator 200 from being separated from the main body portion 100 or shaken upon user's use.

As described above, the connecting part 214 may include the first connecting part 2141 and the second connecting part 2142. In this case, each of the first connecting part 2141 and the second connecting part 2142 may be configured in a flat bar having the same shape. An outer wall of the receiving part 112 may be supported in a manner of contacting the second connecting part 2142.

Figure 9A:
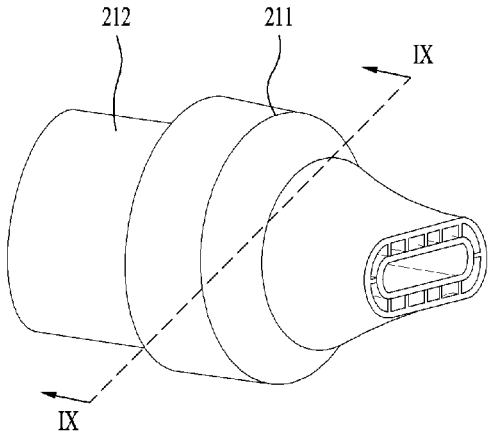
FIGS. 9A-9B are schematic diagrams of a concentrator according to an embodiment, FIG. 9B being a cross-sectional view taken along line IX-IX of FIG. 9A.
Figure 9B:
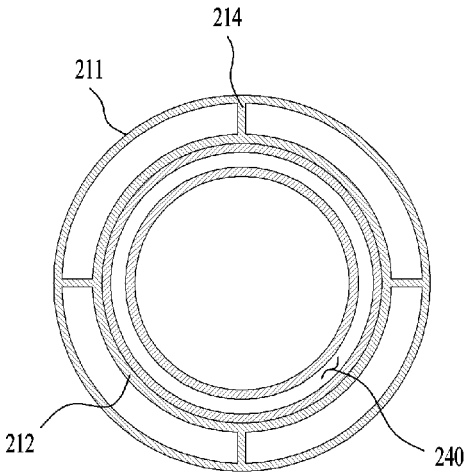

FIGS. 9A-9B are cross-sectional diagram of an outer case according to an embodiment. More particularly, FIG. 9A is a perspective diagram of a concentrator, and FIG. 9B is a cross-sectional diagram of an outer case.

Referring to FIG. 9A and FIG. 9B, the hair dryer 10 according to an embodiment may include a plurality of the connecting parts 214. The plurality of the connecting parts 214 may be provided along a circumference of the body part 212 and connected to the head part 211. Each connecting part 214 may provide coupling power and bearing capacity to the body part 212 and the head part 211 while connecting the body part 212 and the head part 211 together.

If a plurality of the connecting parts 214 is provided, the body part 212 and the head part 211 may have increased coupling power and bearing capacity in comparison to a case in which a single connecting part 214 is provided. However, if a plurality of the connecting parts 214 is provided, a cross-sectional area of the gas discharge part 100 for discharging the gas may be decreased in comparison to the case in which a single connecting part 214 is provided.

A number of the connecting part(s) 214 may be determined in consideration of coupling power and bearing capacity provided to the body part 212 and the head part 211, and gas discharged cross-sectional area of the gas discharge part 110, for example.

FIG. 9B shows that four connecting parts 214 are disposed along the circumference of the body part 212 in a manner of being spaced apart from each other by a predetermined distance. This is just one example only, by which the present disclosure is non-limited.

That is, the number of the connecting part(s) 214 may be determined in consideration of shape, material, weight, and size, for example, of the body part 212. Moreover, the number of the connecting part(s) 214 may be determined in consideration of shape, material, weight, and size, for example, of the head part 211. Further, the number of the connecting part(s) 214 may be determined in consideration of the gas discharged cross-sectional area of the gas discharge part 110.

Figure 10A:
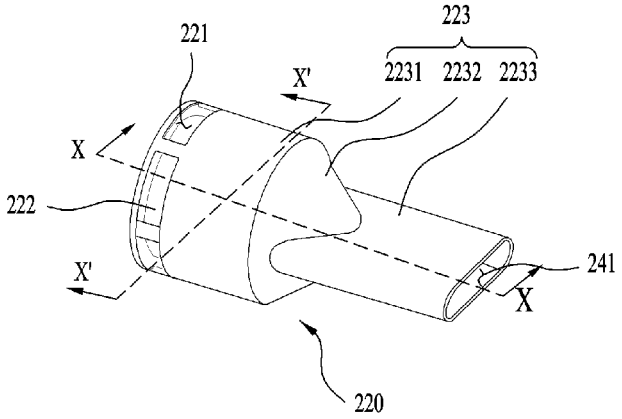
FIGS. 10A-10C are schematic diagrams of a concentrator according to an embodiment, FIG. 10B being a cross-sectional view taken along line X-X of FIG. 10A and FIG. 10C being a cross-sectional diagram view taken along line X'-X' of FIG. 10A.
Figure 10B:
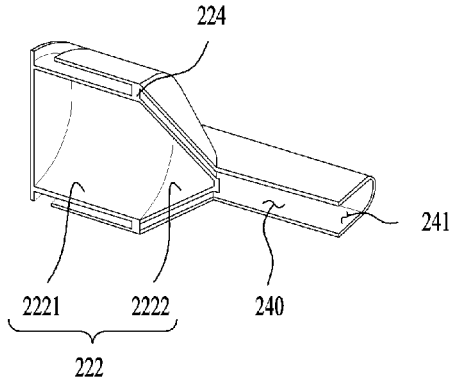

FIGS. 10A-10B are cross-sectional diagrams of a flow path selecting part according to an embodiment. More particularly, FIG. 10A is a perspective diagram of a flow path selecting part, FIG. 10B is a cross-sectional diagram of the flow path selecting part, taken along line X-X of FIG. 10A and FIG. 10C is a cross-sectional diagram of the flow path selecting part in another view, taken along line X'-X' of FIG. 10A.

Figure 10C:
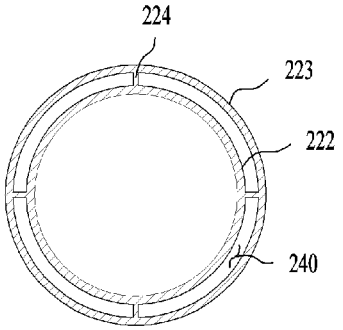

Referring to FIGS. 10A to 10C, the hair dryer 10 according to one embodiment may include a flow path forming part 222 forming the second flow path 240 within the flow path selecting part 220. The flow path selecting part 220 may include a flow path selecting frame 223 that forms an exterior of the flow path selecting part 220. The flow path selecting part 220 may include the flow path forming part 222 provided at a center of the flow path selecting frame 223.

The second flow path 240 may be formed between the flow path forming part 222 and an inner surface of the flow path selecting frame 223. More particularly, the second flow path 240 may be formed between an outer surface of the flow path forming part 222 and the inner surface of the flow path selecting frame 223. A gas flow cross-sectional area of the second flow path 240 may be determined by an inner diameter of the flow path selecting frame 223 and an outer diameter of the flow path forming part 222.

A gas flow area of the gas flowing into the second flow path 240 via the flow path selecting space 213 may be prevented from increasing rapidly by the flow path forming part 222, whereby the flow of the gas may be prevented from becoming unstable, turbulence and backdraft of the gas, for example, may be prevented.

The flow path selecting frame 223 may include a first flow path selecting frame 2231 that projects forward with a predetermined diameter. A front length of the first flow path selecting frame 2231 may be determined in consideration of a contact point between the first flow path selecting frame 2231 and the inner surface of the body part 212.

The flow path selecting frame 223 may include a second flow path selecting frame 2232 that projects from the first flow path selecting frame 2231 in a manner of having a diameter decreasing forward. The second flow path selecting frame 2232 may have a decreased flow cross-sectional area of a gas.

The flow path selecting frame 223 may include a third flow path selecting frame 2233 that projects forward from the second flow path selecting frame 2232 in a manner of having a uniform diameter. Owing to the third flow path selecting frame 2233, the gas concentrated after passing through the second flow path selecting frame 2232 may be made to flow through a flow path having a uniform flow cross-sectional area.

The gas, which is externally discharged after passing through the second flow path 240, may pass through a flow path having a narrow cross-sectional area, thereby concentrating its flow at the center of the second path 240. Thus, the gas may be discharged strongly, whereby a user may use a strong wind.

More particularly, a cross-sectional area of the first flow path 230 for discharging the gas externally may be configured smaller than that of the second flow path 240. Thus, a user who uses the gas discharged through the second flow path may use the gas stronger in flow than the gas discharged through the first flow path 230. As the user may use the strong gas flow, a time taken to dry wet hair may be reduced.

The third flow path selecting frame 2233 may have a front length set longer than that of the first flow path selecting frame 2231. The third flow path selecting frame 2233 may have a front length set longer than that of the second flow path selecting frame 2232. Accordingly, the gas, which passes through the first flow path selecting frame 2231 and the second flow path selecting frame 2232 and is then concentrated in the centerwise direction of the second path 240, may be further concentrated in the third flow path selecting frame 2233 and then discharged externally. That is, as a user can use the strong gas flow, a time taken to dry wet hair can be reduced.

The flow path forming part 222 may be configured in a shape corresponding to the flow path selecting frame 223. That is, the flow path forming part 222 may include a first flow path forming part 2221 spaced apart from an inner surface of the first flow path selecting frame 2231 in a predetermined distance and having a uniform diameter.

The flow path forming part 222 may include a second flow path forming part 2222 spaced apart from an inner surface of the second flow path selecting frame 2232 by a predetermined distance in a manner of having a decreasing diameter. A distance of the first flow path forming part 2221 spaced apart from the inner surface of the first flow path selecting frame 2231 may be set equal to a distance of the second flow path forming part 2222 spaced apart from the inner surface of the second flow path selecting frame 2232. Accordingly, the gas, which has flown into the second flow path 240 before flowing into the third flow path selecting frame 2233, may pass through a flow path having the same flow cross-sectional area.

As a predetermined section of the second flow path 240 is provided with a uniform flow cross-sectional area of a gas, a flow of a gas passing through the predetermined section of the second flow path 240 may be stabilized consistently.

If the flow path selecting part 220 is moved backward within the body part 212 so as to contact with the rear side of the body part 212, a front end portion or end of the third flow path selecting frame 2233 may be located in a same plane of the front end portion of the head part 211 or within the head part 211. Accordingly, when a user uses a gas externally discharged through the first flow path 230, the flow path selecting part 220 may be prevented from being projected externally, thereby being prevented from being broken.

If the flow path selecting part 220 is moved forward within the body part 212, the front end portion of the third flow path selecting frame 2233 may be located in a manner of being externally projected more than the front end portion of the head part 211. Accordingly, a user may press the third flow path selecting frame 2233 with a hand or pressurizes it, thereby moving the flow path selecting part 220 backward within the body part 212. The use may easily vary the position of the flow path selecting part 220.

The hair dryer according to an embodiment may include a plurality of the flow path selection connecting parts 224. The plurality of the flow path selection connecting parts 224 may be provided along a circumference of the flow path forming part 222 and connected to the head part 211.

The flow path selection connecting part 224 may provide coupling power and bearing capacity to the flow path selecting frame 223 and the flow path forming part 222 while connecting the flow path selecting frame 223 and the flow path forming part 222 together.

If the plurality of the flow path selection connecting parts 224 is provided, the flow path selecting frame 223 and the flow path forming part 222 may have increased coupling power and bearing capacity in comparison to a case in which a single flow path selection connecting part 224 is provided.

However, if a plurality of the flow path selection connecting parts 224 is provided, a cross-sectional area of the gas flowing along the second flow path 240 may be decreased in comparison to a case in which the single flow path selection connecting part 224 is provided. A number of the flow path selection connecting part(s) 224 may be determined in consideration of coupling power provided to the flow path selecting frame 223 and the flow path forming part, and the cross-sectional area of the gas flowing along the second flow path 240, for example.

FIG. 10B shows that four flow path selection connecting parts 224 are disposed along a circumference of the flow path forming part 222 in a manner of being spaced apart from each other by a predetermined distance. This is just one example only, by which the present disclosure is non-limited.

That is, the number of the flow path selection connecting part(s) 224 may be determined in consideration of a shape, material, weight, and size, for example, of the flow path forming part 222. Moreover, the number of the flow path selection connecting part(s) 224 may be determined in consideration of a shape, material, weight, and size, for example, of the flow path selecting frame 223. Further, the number of the flow path selection connecting part(s) 224 may be determined in consideration of the cross-sectional area of the gas flowing along the second flow path 240, for example.

Figure 11:
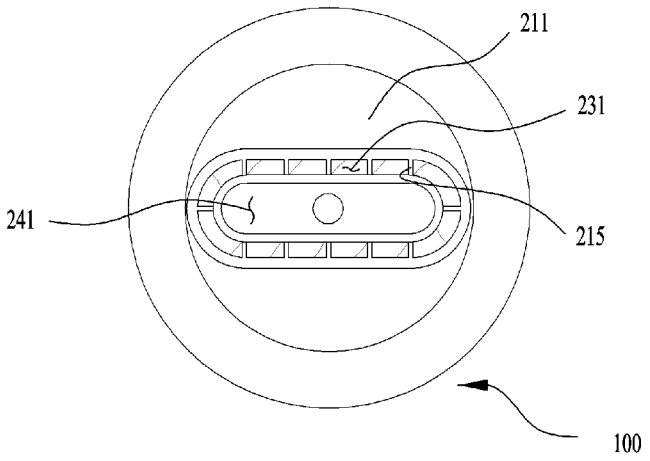
FIG. 11 is a diagram showing a first flow path discharge hole and a second flow path discharge hole according to an embodiment.

FIG. 11 is a diagram showing a first flow path discharge hole and a second flow path discharge hole according to an embodiment. Referring to FIG. 11, the hair dryer 10 according to an embodiment may include a first flow path discharge hole 231 and a second flow path discharge hole 241.

More particularly, the first flow path 230 may include a first flow path discharge hole 231 that externally discharges the gas discharged from the gas discharge part 110. The second flow path 240 may include a second flow path discharge hole 241 that externally discharges the gas discharged from the gas discharge part 110.

A cross-sectional area of the first flow path discharge hole 231 may be configured different from that of the second flow path discharge hole 241. That is, a property of the gas externally discharged through the first flow path 230 may be changed depending on a size and shape of the first flow path discharge hole 231. Moreover, a property of the gas externally discharged through the second flow path 240 may be changed depending on a size and shape of the second flow path discharge hole 241.

The shape and size of the first flow path discharge hole 231 may become main factors for determining the property of the externally discharged gas. The shape and size of the second flow path discharge hole 241 may become main factors for determining the property of the externally discharged gas.

As a cross-sectional area of the first flow path discharge hole 231 is configured different from that of the second flow path discharge hole 241, the gas externally discharged through the first flow path 230 may differ from the gas externally discharged through the second flow path 240 in property.

The first flow path discharge hole 231 may be configured to enclose the second flow path discharge hole 241. A cross-sectional area of the first flow path discharge hole 231 may be configured greater than that of the second flow path discharge hole 241.

As the first flow path discharge hole 231 is configured to enclose the second flow path discharge hole 241, the cross-sectional area of the first flow path discharge hole 231 may be configured greater than that of the second flow path discharge hole 241 to facilitate manufacturing. As the cross-sectional area of the first flow path discharge hole 231 is configured greater than that of the second flow path discharge hole 241, a flow speed of the gas externally discharged through the first flow path discharge hole 231 may be slower than that of the gas externally discharged through the second flow path discharge hole 241.

Therefore, when a user uses the gas discharged externally through the first flow path discharge hole 231, the user may have a soft tactile impression. On the other hand, when the user uses the gas discharged through the second flow path discharge hole 241, the user may have a strong tactile impression.

For user convenience, the user may move the flow path selecting part 220, thereby selecting a path through which the gas discharged from the gas discharge part 110 flows. When the user uses the gas externally discharged through the first flow path discharge hole 231, wet hair may be dried more slowly than a case of using the gas externally discharged through the second flow path discharge hole 241. In addition, this may be advantageous in styling hair into a user-desired shape. When the user uses the gas externally discharged through the second flow path discharge hole 241, wet hair may be dried more quickly than a case of using the gas externally discharged through the first flow path discharge hole 231.

A first guide part (guide) 215 may be provided to or at a front end portion or end of the outer case 210. A plurality of the first guide parts 215 may be provided within the first flow path 230.

The first guide part 215 may guide flow of the gas externally discharged through the first flow path discharge hole 231. The gas flowing in the first flow path 230 may be externally discharged through a space between the first guide parts 215.

The first guide part 215 may prevent bending of the flow toward a center of the first flow path discharge hole 231 in the flow externally discharged through the first flow path discharge hole 231. Dispersion of the flow externally discharged through the first flow path discharge hole 231 may be prevented maximally.

Accordingly, a user may use the gas having a relatively soft property in case in which the first guide part 215 is provided in comparison to a case in which the first guide part 215 is not provided. In addition, the first guide part 215 may be configured in helical form. Thus, the helical form may maximize the effects that can be obtained with the first guide part 215.

Accordingly, embodiments disclosed herein are directed to a hair dryer that substantially obviates one or more problems due to limitations and disadvantages of the related art.

Embodiments disclosed herein provide a hair dryer configured to increase a coupling power between a main body portion and an accessory capable of having a plurality of gas flow types, thereby improving safety upon user use and preventing breakage of the accessory due to separation of the accessory.

Embodiments disclosed herein provide a hair dryer that increases coupling power and bearing capability between a concentrator and a main body portion in a manner that a space for receiving the concentrator therein is separately provided to the main body portion.

A hair dryer according to embodiments disclosed herein may include a main body portion (main body) having a gas discharge part (discharge) provided to or at a front side to discharge a gas externally, a handle part (handle) that extends from the main body portion, and a concentrator detachably coupled to the main body portion and externally discharging the gas received from the gas discharge part. The concentrator may include a head part (head) having at least one flow path provided therein to enable the gas discharged from the gas discharge part to flow, and a body part (body) that extends backward from the head part and coupled to the main body portion.

The gas discharge part may include a receiving part or portion provided at a center of the gas discharge part to receive the body part therein, and a gas discharge hole provided between an inner surface of the main body portion and the receiving part in a manner of enclosing the receiving part to discharge the gas.

The concentrator may include a gas flow hole provided between the head part and the body part so that the gas discharged from the gas discharge hole flows in. The gas flow hole may be provided to enclose the body part and confront the gas discharge hole.

An outer wall of the head part may be coupled to an outer wall of the main body portion. An outer surface of the head part and an outer surface of the main body portion may form a continuous surface together, and an inner surface of the head part and an inner surface of the main body portion may form a continuous surface together.

A front side of the receiving part may be open to receive the body part therein. A rear side of the body part may be received in the receiving part to contact a rear side of the receiving part.

The concentrator may further include a connecting part or portion that connects the head part and the body part. The connecting part may be supported by an outer wall of the receiving part.

The concentrator may further include a flow path selecting part (selector) a position of which is variable within the concentrator. A first flow path may be provided between the head part and the flow path selecting part of the concentrator, and a second flow path may be provided within the flow path selecting part. The concentrator may be provided in a manner that the gas discharged from the gas discharge part is externally discharged along either the first flow path or the second flow path depending on the position of the flow path selecting part.

The flow path selecting part may be provided to be received within the body part in a manner of being movable forward or backward. A front side of the body part may be open to have the flow path selecting part received therein, and the flow path selecting part may be received in the body part to contact a rear side of the body part. When the flow path selecting part is moved forward in the body part to contact an inner surface of the head part, the first flow path may be closed by an outer surface of the flow path selecting part and the second flow path may be open so that the gas discharged from the gas discharge hole flows through the second flow path.

The flow path selecting part may include a flow path selection flowing hole that communicates with the second flow path depending on the position of the flow path selecting part. If the flow path selection flowing hole is closed as the flow path selecting part is moved backward in the body part, the second flow path may be closed so that the gas discharged from the gas discharge hole may flow through the first flow path to be externally discharged.

The first flow path may include a first flow path discharge hole that discharges the gas discharged from the gas discharge part externally. The second flow path may include a second flow path discharge hole that discharges the gas discharged from the gas discharge part externally.

A cross-sectional area of the first flow path discharge hole may be configured different from that of the second flow path discharge hole. The first flow path discharge hole may be configured to enclose the second flow path discharge hole and the cross-sectional area of the first flow path discharge hole may be provided greater than that of the second flow path discharge hole.

The receiving part may be provided in a hollow cylindrical shape. The body part may be provided in a hollow cylindrical shape and inserted in the receiving part, and a portion of the flow path selecting part received in the body part may be provided in a cylindrical shape and movably inserted in the body part.

At least one of the receiving part or the body part may include a receiving discharge part (discharge) enabling a space between a rear side of the receiving part and the body part to communicate with an outside of the receiving part.

Accordingly, embodiments disclosed herein provide the following effects and/or advantages.

First, a concentrator having a plurality of flow paths may increase coupling power and bearing capability with a hair dryer.

Second, when a hair dryer is used by a user, a concentrator is prevented from being separated and shaken, thereby enhancing user convenience in using the hair dryer.

Third, when a hair dryer is used by a user, a concentrator is prevented from being separated from the hair dryer, thereby increasing user safety in using the hair dryer and decreasing the risk of injury, Fourth, when a user selects and changes a flow path for convenience, a strong coupling power is provided, thereby enabling a flow path to be changed conveniently.

Effects obtainable from embodiments disclosed herein may be non-limited by the above-mentioned effects. Other unmentioned effects may be clearly understood from the description by those having ordinary skill in the technical field to which the embodiments pertains. It is to be understood that both general description and detailed description are exemplary and explanatory and are intended to provide further explanation.

It will be apparent to those skilled in the art that various modifications and variations can be made without departing from the spirit or scope. Thus, it is intended that embodiments cover modifications and variations provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer, comprising:

a main body having a gas discharge provided at a front side to discharge a gas externally;

a handle that extends from the main body; and a concentrator configured to be detachably coupled to the main body, the concentrator externally discharging the gas received from the gas discharge, wherein the concentrator comprises a head having at least one flow path provided therein through which the gas discharged from the gas discharge flows and a body that extends rearward from the head, the body being configured to be coupled to the main body, wherein the gas discharge comprises a receiving portion provided at a center of the gas discharge to receive the body therein and a gas discharge hole to discharge the gas, the gas discharge hole being provided between an inner surface of the main body and the receiving portion in a manner of enclosing the receiving portion, wherein the concentrator comprises a gas flow hole provided between the head and the body through which the gas discharged from the gas discharge hole flows, and wherein a rear surface of the receiving portion is closed to prevent the gas from flowing toward an inside of the body.

2. The hair dryer of claim 1, wherein an outer wall of the head is coupled an outer wall of the main body such that an outer surface of the head and an outer surface of the main body form a continuous surface together and an inner surface of the head and an inner surface of the main body form a continuous surface together.

3. The hair dryer of claim 1, wherein a front side of the receiving portion is open to receive the body therein, and wherein a rear side of the body is received in the receiving portion to contact a rear side of the receiving portion.

4. The hair dryer of claim 3, wherein the concentrator further comprises a connecting portion that connects the head and the body, and wherein the connecting portion is supported by an outer wall of the receiving portion.

5. The hair dryer of claim 1, wherein the concentrator further comprises a flow path selector a position of which is variable within the concentrator, wherein a first flow path is provided between the head and the flow path selector, wherein a second flow path is provided within the flow path selector, and wherein the gas discharged from the gas discharge is externally discharged along either the first flow path or the second flow path depending on the position of the flow path selector.

6. The hair dryer of claim 5, wherein the flow path selector is configured to be received within the body in a manner of being movable forward or backward.

7. The hair dryer of claim 6, wherein a front side of the body is open and configured to receive the flow path selector therein, and wherein when the flow path selector is received in the body, the flow path selector contacts a rear side of the body.

8. The hair dryer of claim 7, wherein the receiving portion has a hollow cylindrical shape, wherein the body has a hollow cylindrical shape and is inserted into the receiving portion, and wherein a portion of the flow path selector received in the body has a cylindrical shape and is movably inserted into the body.

9. The hair dryer of claim 8, wherein at least one of the receiving portion or the body comprises a receiving discharge portion that enables a space between a rear side of the receiving portion and the body to communicate with an outside of the receiving portion.

10. The hair dryer of claim 6, wherein when the flow path selector is moved forward in the body to contact an inner surface of the head, the first flow path is closed by an outer surface of the flow path selector and the second flow path is open so that the gas discharged from the gas discharge hole flows through the second flow path.

11. The hair dryer of claim 6, wherein the flow path selector comprises a flow path selection flow hole that communicates with the second flow path depending on the position of the flow path selector, and wherein if the flow path selection flow hole is closed as the flow path selector is moved backward in the body, the second flow path is closed so that the gas discharged from the gas discharge hole flows through the first flow path to be externally discharged.

12. The hair dryer of claim 5, wherein the first flow path comprises a first flow path discharge hole that discharges the gas discharged from the gas discharge externally, wherein the second flow path comprises a second flow path discharge hole that discharges the gas discharged from the gas discharge externally, and wherein a cross-sectional area of the first flow path discharge hole is different from a cross-sectional area of the second flow path discharge hole.

13. The hair dryer of claim 12, wherein the first flow path discharge hole encloses the second flow path discharge hole, and wherein the cross-sectional area of the first flow path discharge hole is larger than the cross-sectional area of the second flow path discharge hole.

14. A hair dryer, comprising:

a main body having a gas discharge provided at a front side to discharge a gas externally;

a handle that extends from the main body; and a concentrator configured to be detachably coupled to the main body, the concentrator externally discharging the gas received from the gas discharge, wherein the concentrator comprises a head having a plurality of flow paths provided therein through which the gas discharged from the gas discharge selectively flows and a body that extends rearward from the head, the body being configured to be coupled to the main body, wherein the gas discharge comprises a gas discharge hole to discharge the gas, the gas discharge hole extending along a periphery of the main body, wherein the concentrator comprises a gas flow hole provided between the head and the body through which the gas discharged from the gas discharge hole flows, and wherein a rear surface of the body is closed to prevent the gas from flowing from the gas discharge into the body.

15. The hair dryer of claim 14, wherein an outer wall of the head is coupled an outer wall of the main body such that an outer surface of the head and an outer surface of the main body form a continuous surface together and an inner surface of the head and an inner surface of the main body form a continuous surface together.

16. The hair dryer of claim 14, wherein the concentrator further comprises a flow path selector a position of which is variable within the concentrator, wherein the plurality of flow paths comprises a first flow path provided between the head and the flow path selector and a second flow path provided within the flow path selector, and wherein the gas discharged from the gas discharge is externally discharged along either the first flow path or the second flow path depending on the position of the flow path selector.

17. The hair dryer of claim 16, wherein the flow path selector is configured to be received within the body and is movable forward or backward in a longitudinal direction of the body.

18. The hair dryer of claim 17, wherein when the flow path selector is moved forward in the body to contact an inner surface of the head, the first flow path is closed by an outer surface of the flow path selector and the second flow path is open so that the gas discharged from the gas discharge hole flows through the second flow path.

19. The hair dryer of claim 17, wherein the flow path selector comprises a flow path selection flow hole that communicates with the second flow path depending on the position of the flow path selector, and wherein if the flow path selection flow hole is closed as the flow path selector is moved backward in the body, the second flow path is closed so that the gas discharged from the gas discharge hole flows through the first flow path to be externally discharged.

20. The hair dryer of claim 17, wherein the first flow path comprises a first flow path discharge hole that discharges the gas discharged from the gas discharge externally, wherein the second flow path comprises a second flow path discharge hole that discharges the gas discharged from the gas discharge externally, and wherein a cross-sectional area of the first flow path discharge hole is different from a cross-sectional area of the second flow path discharge hole.

* * * * *